US009458664B2

(12) United States Patent
Wen et al.

(10) Patent No.: US 9,458,664 B2
(45) Date of Patent: Oct. 4, 2016

(54) ADJUSTABLE CORD LOCKER AND WINDOW BLIND HAVING SUCH ADJUSTABLE CORD LOCKER

(71) Applicant: NIEN MADE ENTERPRISE CO., LTD., Taichung (TW)

(72) Inventors: Yu-Che Wen, Taoyuan (TW); Chao-Hung Nien, Taichung (TW); Xu-Wu Qu, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 17 days.

(21) Appl. No.: 14/447,887

(22) Filed: Jul. 31, 2014

(65) Prior Publication Data

US 2016/0032645 A1 Feb. 4, 2016

(51) Int. Cl.
*E06B 9/324* (2006.01)
*E06B 9/388* (2006.01)

(52) U.S. Cl.
CPC ..... *E06B 9/324* (2013.01); *E06B 9/388* (2013.01)

(58) Field of Classification Search
CPC ..... E06B 9/326; E06B 9/324; E06B 9/322
USPC ..... 160/178.2, 178.1 R, 173 R, 168.1 R, 160/178.3; 242/396.2, 378.1–378.3, 242/388.1–388.5
See application file for complete search history.

(56) References Cited

U.S. PATENT DOCUMENTS 898,083 A * 9/1908 Amstalden ..... B60R 22/3408 191/12.2 R
1,089,023 A * 3/1914 Trautner ..... B65H 75/38 242/396.4
2,187,458 A * 1/1940 Lawson ..... E06B 9/325 160/125
3,123,130 A * 3/1964 Fridlund ..... E06B 9/322 160/168.1 R
4,633,599 A * 1/1987 Morell ..... A43C 11/16 24/68 SK
5,042,177 A * 8/1991 Schoch ..... A43C 11/16 24/68 SK
5,402,958 A * 4/1995 Mahaney ..... G09F 3/0352 24/68 R
5,630,456 A * 5/1997 Hugo ..... E06B 9/326 160/173 R
5,669,116 A * 9/1997 Jungkind ..... A43C 11/16 24/68 SK
5,791,580 A * 8/1998 Anderson ..... B65H 75/4423 160/178.2
5,918,658 A * 7/1999 Schartner ..... E06B 9/30 160/173 R
6,015,110 A * 1/2000 Lai ..... B65H 75/28 242/388.1
6,263,946 B1 * 7/2001 Cotten ..... E06B 9/382 160/178.1 R (Continued)

FOREIGN PATENT DOCUMENTS

DE 102009008774 * 8/2010 ..... E06B 9/323

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

An adjustable cord locker for fastening at least a lift cord to a bottom rail and regulating a length of the lift cord includes a barrel, a reel, and a control wheel. The reel is received in the barrel for rotation by control. The lift cord is inserted into the barrel and fastened to the reel to be wound around the reel when the reel is turning. The control wheel is connected to the reel for a user to operate to turn the reel. The control wheel is provided with teeth, and the barrel is provided with a pawl. The pawl is engaged with the teeth to allow the control wheel to be turned or hold still.

18 Claims, 14 Drawing Sheets

(56) References Cited

U.S. PATENT DOCUMENTS 6,390,519 B1 * 5/2002 Dreisbach ..... G09F 3/0364 242/388.1
6,530,415 B2 * 3/2003 Wu ..... E06B 9/32 160/168.1 R
6,681,831 B1 * 1/2004 Cheng ..... E06B 9/262 160/170
6,745,969 B1 * 6/2004 Gouda ..... E06B 9/326 160/178.1 R
6,792,997 B2 * 9/2004 Damiano ..... E06B 9/303 160/168.1 R
7,025,107 B2 * 4/2006 Ciuca ..... E06B 9/322 160/170
7,159,636 B2 * 1/2007 Liang ..... E06B 9/30 160/115
7,178,576 B2 * 2/2007 Nien ..... E06B 9/303 160/168.1 R
7,331,371 B1 * 2/2008 Kovach ..... E06B 9/326 160/178.1 R
7,578,334 B2 * 8/2009 Smith ..... E06B 9/262 160/121.1
7,614,578 B2 * 11/2009 Ito ..... H04R 1/1033 242/385.4
7,797,839 B2 * 9/2010 Proulx ..... A01D 34/416 30/276
8,231,109 B2 * 7/2012 Peng ..... B65H 75/28 242/388.5
8,857,494 B2 * 10/2014 Kirby ..... E06B 9/388 160/173 R
8,944,135 B2 * 2/2015 Spray ..... E06B 9/262 160/168.1 R
9,212,519 B2 * 12/2015 Vrooman ..... E06B 9/367
2005/0098673 A1 * 5/2005 Huang ..... A43C 7/00 242/395
2006/0239491 A1 * 10/2006 Ito ..... H04R 1/1033 381/384
2007/0089839 A1 * 4/2007 Collum ..... E06B 9/388 160/168.1 R
2009/0294076 A1 12/2009 McNiel
2010/0206492 A1 * 8/2010 Shevick ..... E06B 9/30 160/170
2011/0177750 A1 * 7/2011 Ujita ..... A63H 1/04 446/263
2012/0060329 A1 * 3/2012 Zhang ..... E06B 9/384 24/115 F
2014/0291431 A1 * 10/2014 Huang ..... E06B 9/322 242/372
2014/0374034 A1 * 12/2014 Corey ..... E06B 9/262 160/170
2015/0101764 A1 * 4/2015 Cheng ..... E06B 9/322 160/244
2015/0157155 A1 * 6/2015 Howsey ..... A47G 25/32 223/95

* cited by examiner

ADJUSTABLE CORD LOCKER AND WINDOW BLIND HAVING SUCH ADJUSTABLE CORD LOCKER

BACKGROUND OF THE INVENTION

1. Technical Field

The present invention relates generally to window coverings, and more particularly to an adjustable cord locker, and a window blind equipped with the adjustable cord locker.

2. Description of Related Art

Typically, a conventional window blind is provided with a headrail, a bottom rail, and a plurality of slats between the headrail and the bottom rail. The slats are connected to the headrail and the bottom rail through ladder cords and lift cords. The ladder cords controls tilt of the slats, and the lift cord controls the bottom rail to lift and lower.

The ladder cords and the lift cords will be lengthened while the ladder cords and the lift cords are working under tensions for a long time. Once the ladder cords are lengthened, a distance between the headrail and the bottom rail increases, and the slats might tilt from the normal. U.S. 2009/0294076 application provides a window blind, in which a cord locker is provided. The cord locker is provided with a turnable reel to wind the ladder cords therearound once the ladder cords are lengthened. However, this invention is unable to fix the problem of extension of the lift cord. As a result, the slats tilt for a large angle because of the tension and the length of the lift cord are different from that of the ladder cords.

BRIEF SUMMARY OF THE INVENTION

In view of the above, the primary objective of the present invention is to provide an adjustable cord locker and a window blind having the adjustable cord locker, which is able to regulate the length of the lift cord to balance the bottom rail.

In order to achieve the objective of the present invention, an adjustable cord locker includes a barrel; and a reel received in the barrel for rotation by control, wherein a lift cord is fastened to the reel to wind the lift cord around the reel while the reel is rotated.

The present invention further provides a window blind, including a headrail; a bottom rail; a plurality of slats between the headrail and a bottom rail; and at least a lift cord passing through the headrail and the slats in sequence, and connected to the bottom rail through an adjustable cord locker. The adjustable cord locker includes a barrel; and a reel received in the barrel for rotation, wherein the lift cord is fastened to the reel to wind the lift cord around the reel while the reel is rotated.

Whereby, the length of the lift cord could be regulated by turning the reel to balance the bottom rail.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
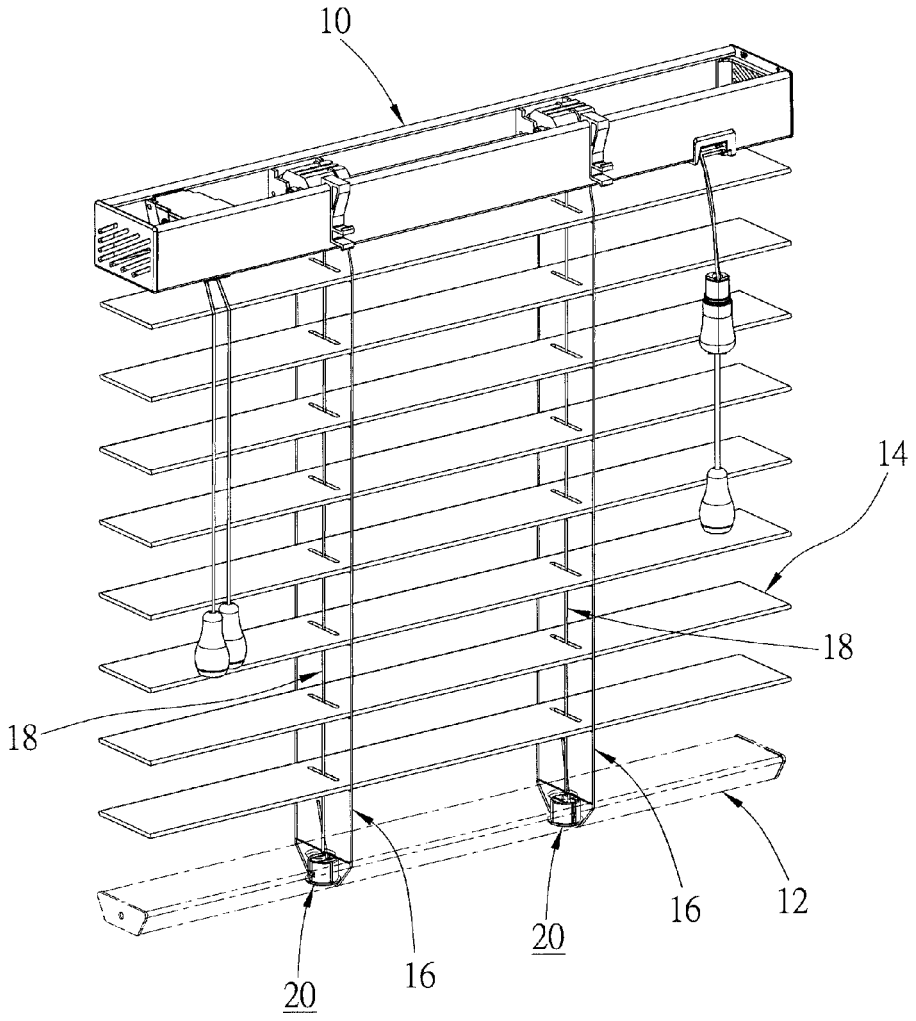
FIG. 1 is a perspective view of the window blind of a first preferred embodiment of the present invention.

As shown in FIG. 1 to FIG. 4, a window blind 1, of the first preferred embodiment of the present invention includes a headrail 10, a bottom rail 12, and a plurality of slats 14 between the headrail 10 and the bottom rail 12. Two ladder cords 16 are connected to the headrail 10 and the bottom rail 12, and the slats 14 are spaced and supported by the ladder cords 16 between the headrail 10 and the bottom rail 12. A lift cord 18 has an end fastened to the bottom rail 12, passes through the slats 14 in sequence, goes into the headrail 10, and then goes out of the headrail 10 to beheld and operated by a user. The above elements and structure are the same as the conventional device, so we do not describe the detail here.

Figure 2:
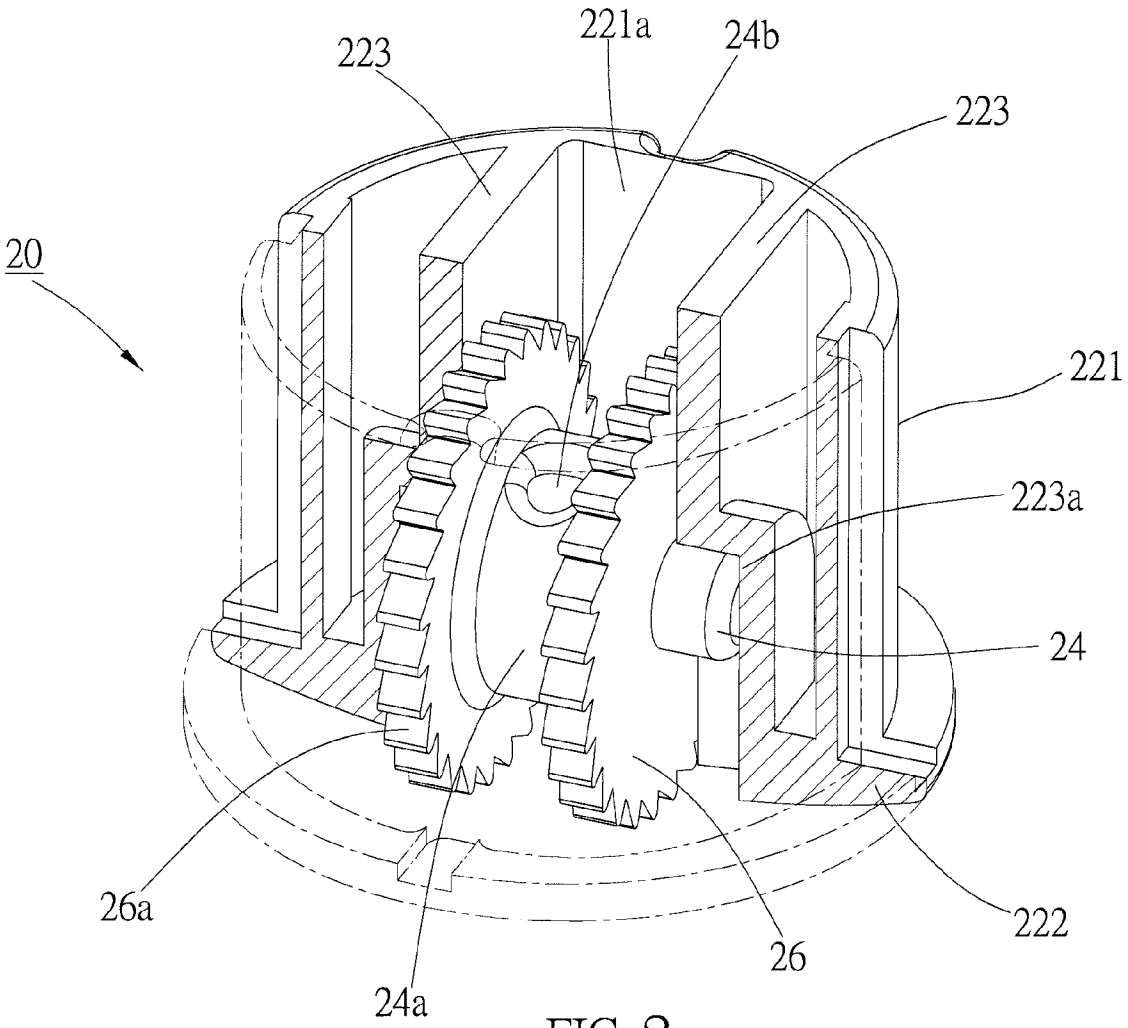
FIG. 2 and FIG. 3 are sectional views of the cord locker of the first preferred embodiment of the present invention.
Figure 3:
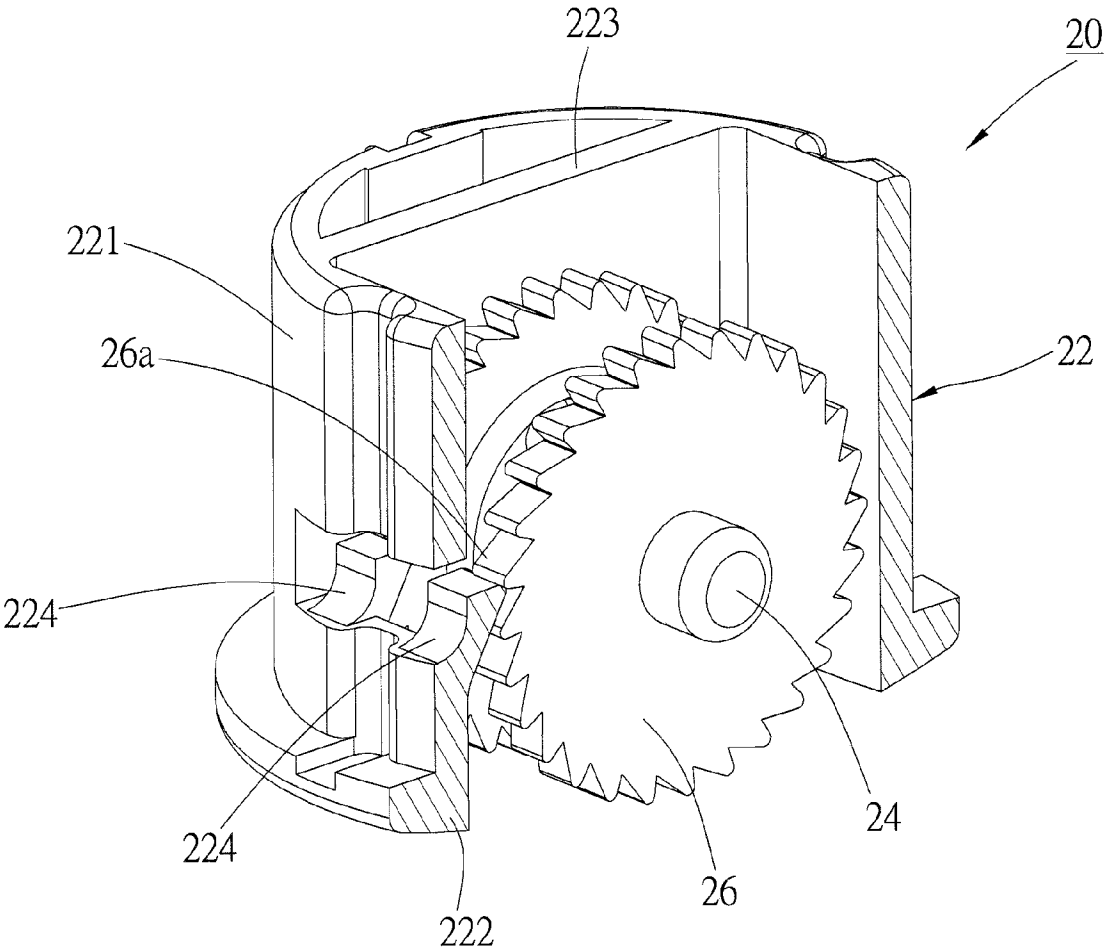
Figure 4:
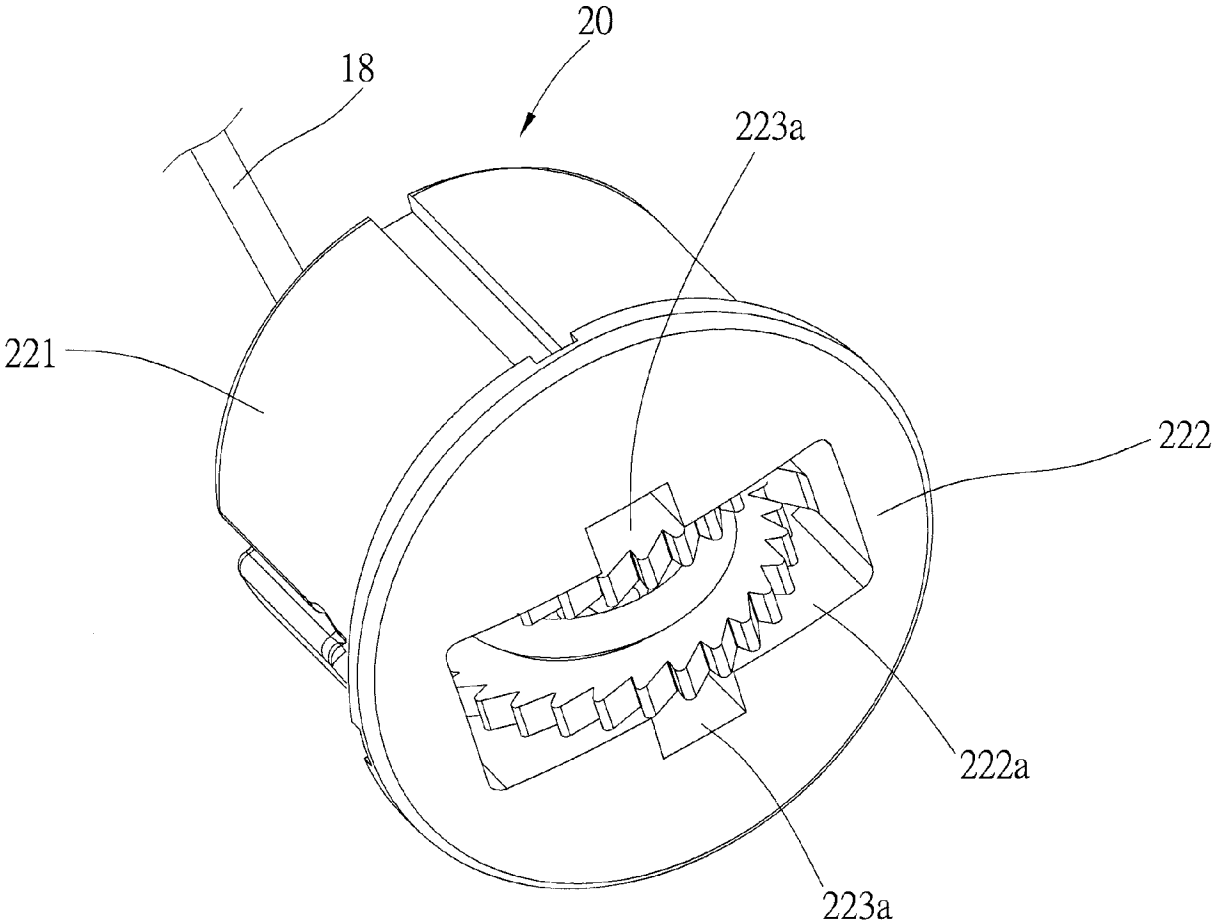
FIG. 4 is a perspective view of the cord locker of the first preferred embodiment of the present invention.

The window blind 1 further is provided with two adjustable cord lockers 20, which are received in bores on a bottom of the bottom rail 12. The lift cords 18 are fastened to the cord lockers 20 respectively to be connected to the bottom rail 12. In the present embodiment, each cord locker 20 has a barrel 22, a reel 24, and two control wheels 26. As shown in FIG. 2 to FIG. 4, the barrel 22 has a cylinder 221, a bottom board 222, two rib board 223, and two pawls 224. The cylinder 221 is hollow, and has a top opening 221*a* at a top thereof for the lift cord 18 passing through. The bottom board 222 is connected to a bottom of the cylinder 221, and has a bottom opening 222*a*. The bottom opening 222*a* is communicated with the top opening 221*a*. The rib boards 223 are parallel, and received in the cylinder 221. The rib boards 223 have opposite ends connected to the cylinder 221, and a bottom end connected to the bottom board 222. Each rib board 223 is provided with a slot 223*a* at a side facing each other. The bottom opening 222*a* is communicated with the slots 223*a*. The pawls 224 are two hooks projected from an inner side of the cylinder 221.

The reel 24 is a round rod having a cord portion 24*a* and a cord hole 24*b* on the cord portion 24*a*. The lift cord 18 passes through the cord hole 24*b* after the top opening 221*a*, and then is knotted. The lift cord 18 will be wound around the cord portion 24*a* while the reel 24 is turning. The reel 24 is transversely arranged in the cylinder 221 with opposite ends engaging the slots 223*a* of the rib boards 223, which means that the reel 24 is vertical to an axial direction of the barrel 22. The reel 24 is dragged by the lift cord 18, so that the reel 24 rests against top sidewalls of the slots 223*a*, and is turnable.

The control wheels 26 are fixed to the reel 24, and the cord portion 24*a* is between the control wheels 26. The reel 24 works like an axle of the control wheels 26. In the present embodiment, the control wheels 26 and the reel 24 are made into a single element. In another embodiment, the control wheels are two independent elements fixed to the reel. Each control wheel 26 has teeth 26*a* on a circumference thereof. In the present embodiment, the teeth 26*a* are ratchet teeth. As shown in FIG. 4, some of the teeth 26 extend out of the cylinder 221 via the bottom opening 222*a* to be operated by user to turn the reel 24.

While one of the teeth 26*a* engaging the pawl 224, as shown in FIG. 3, the reel 24 stay still until one drives the control wheels 26. In other words, the cord locker 20 of the present invention may wind the lift cord 18 around the reel 24 in one direction to regulate the length change of the lift cord 18, and to balance the bottom rail 12.

Figure 5:
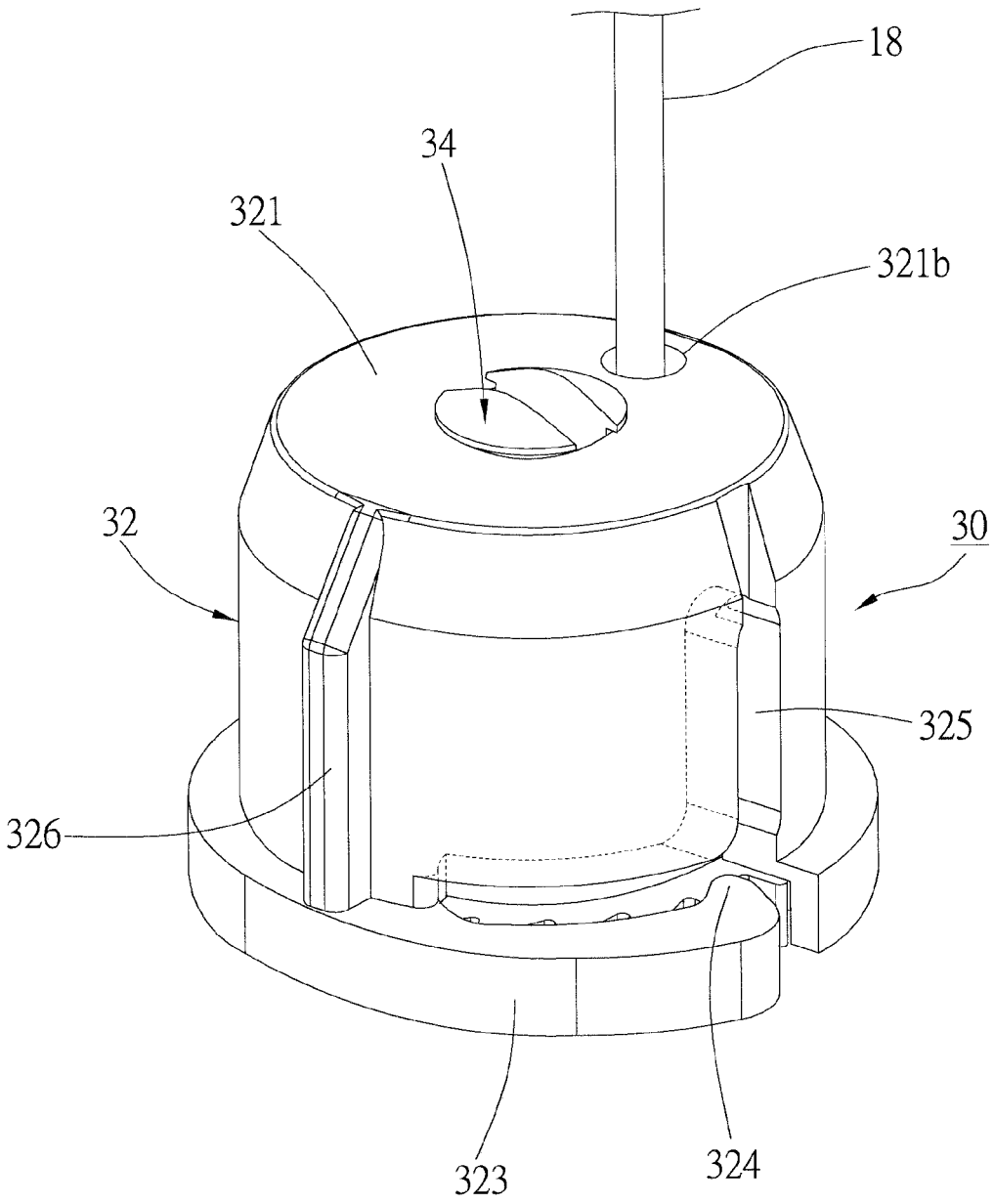
FIG. 5 is a perspective view of the cord locker of a second preferred embodiment of the present invention.
Figure 6:
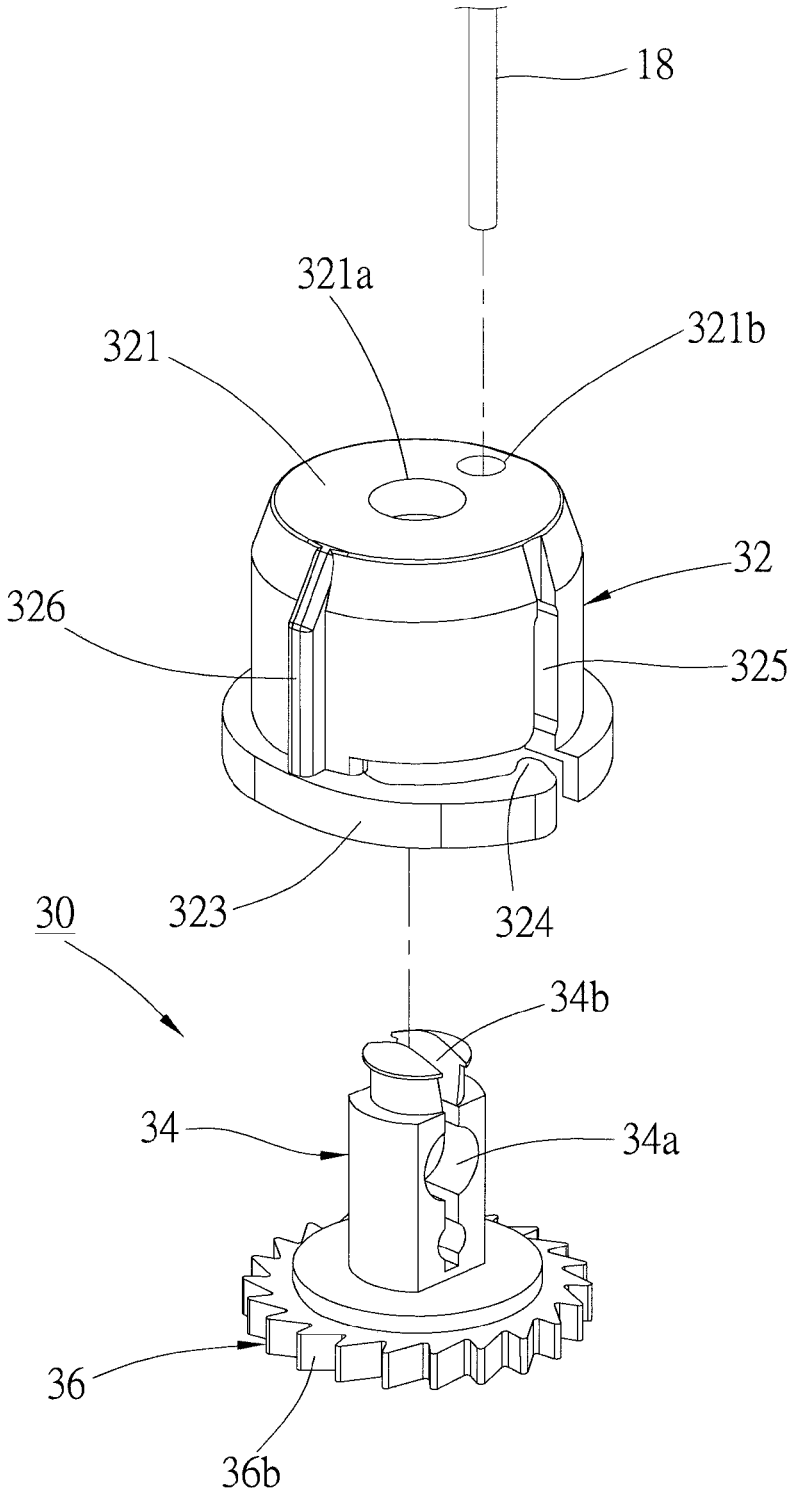
FIG. 6 is an exploded view of the cord locker of the second preferred embodiment of the present invention.
Figure 7:
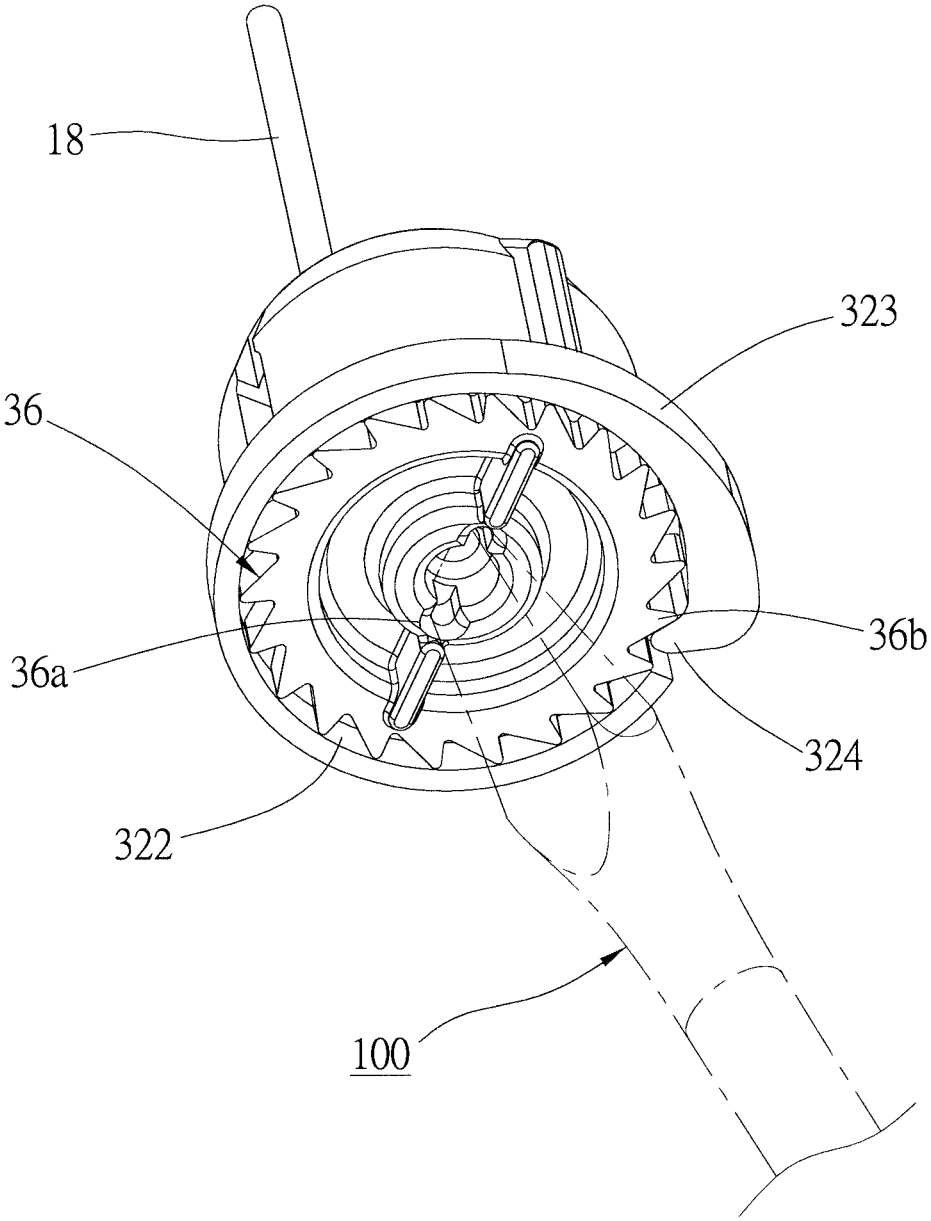
FIG. 7 is a perspective view of the cord locker of the second preferred embodiment of the present invention, showing the control wheel being turned by a screwdriver.

A cord locker 30 of the second preferred embodiment is shown in FIG. 5 to FIG. 7, which includes a barrel 32, a reel 34, and a control wheel 36. The different part of the cord locker 30 of the second preferred embodiment is that a top board 321 is connected to a top of the barrel 32. The top board 321 is provided with a bore 321*a* and a top opening 321*b*. A lift cord 18 is inserted into the top opening 321*b*. The barrel 32 is provided with a bottom opening 322 and a flexible arm 323 at a bottom thereof. The flexible arm 323 has a pawl 324, which is a protrusion, on an inner side and adjacent to a free end thereof.

The control wheel 36 is connected to an end of the reel 34. The reel 34 is vertical, parallel to the axial direction of the barrel 32, and inserted into the bore 321*a* via the bottom opening 322 while the control wheel 36 covers the bottom opening 322 of the barrel 32. The reel 34 has a cord hole 34*a* and a slot 34*b*. The cord hole 34*a* is radially passing through the reel 34, and the slot 34*b* breaks the reel 34 into two pieces from a free end, through the cord hole 34*a*, to a position adjacent to the control wheel 36. The reel 34 is provided with a recess at an end of the cord hole 34*a*, and the recess is larger than the cord hole 34*a*. At distal ends of the pieces of the reel 34 two hooks are provided. The hooks extend out of the bore 321*a* and hook an edge of the bore 321*a* that the reel 34 and the control wheel 36 will not escape from the barrel 32, but are turnable. The lift cord 18 is inserted into the top opening 321*b*, and then goes through the cord hole 34*a* via an end opposite to the recess, so that a knot of the lift cord 18 is received in the recess. As a result, the lift cord 18 is fastened to the reel 34, and wound around the reel 34 while the reel 34 is turning.

The control wheel 36 is provided with a driving portion 36*a* at a bottom thereof for an external force to engage to turn the control wheel 36, and the reel 34 will be turned at the same time to wind the lift cord 18. In the present embodiment, the driving portion 36*a* includes a straight slot for a screwdriver 100 (dot line in FIG. 7) to engage and turn the control wheel 36 by turning the screwdriver 100. The driving portion 36*a* further includes two protrusions at opposite ends of the straight slot for a user to hold them to turn the control wheel 36. The control wheel 36 is provided with ratchet teeth 36*b* on a circumference to be engaged with the pawl 324 that the reel 34 and the control wheel 36 are able to turn in one direction only. The function of the second preferred embodiment is the same as above, so we do not describe it again.

In addition to the top opening 321*b*, the barrel 32 is provided with two side openings 325 on an annular wall thereof. The lift cord 18 may be inserted into the barrel 32 through any of the side openings 325 instead of the top opening 321*b* to be fastened to the reel 34. Some window blinds are provided with two or more lift cords, and these lift cords do not pass through the slats. For this kind of lift cords, two of the lift cords could be inserted into the side openings 325 respectively to be fastened to the reel 34. The barrel 32 further is provided with several ribs 326 on the annular wall make the barrel 32 firmed engage the bore of the bottom rail 12.

Figure 8:
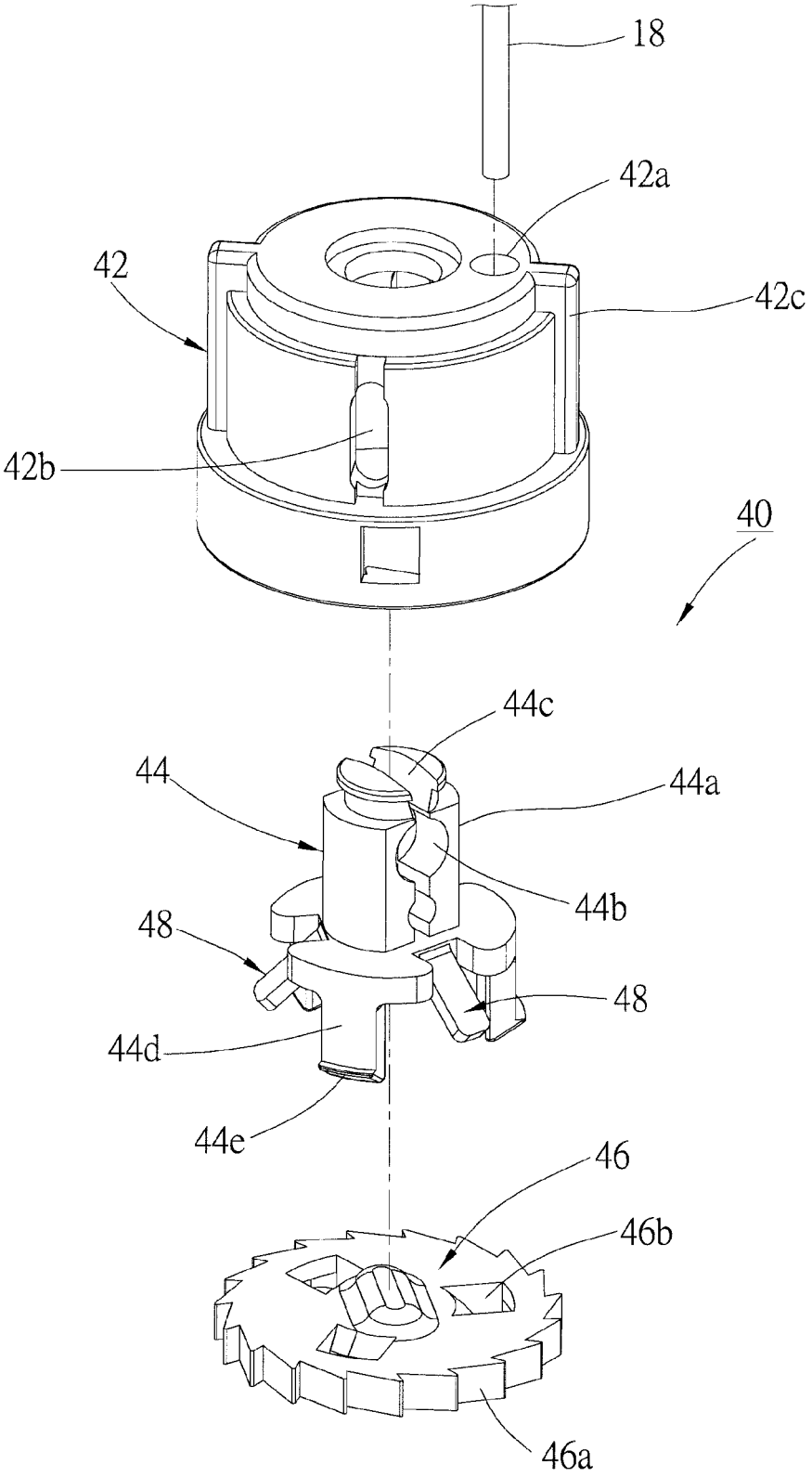
FIG. 8 is an exploded view of the cord locker of a third preferred embodiment of the present invention.
Figure 9:
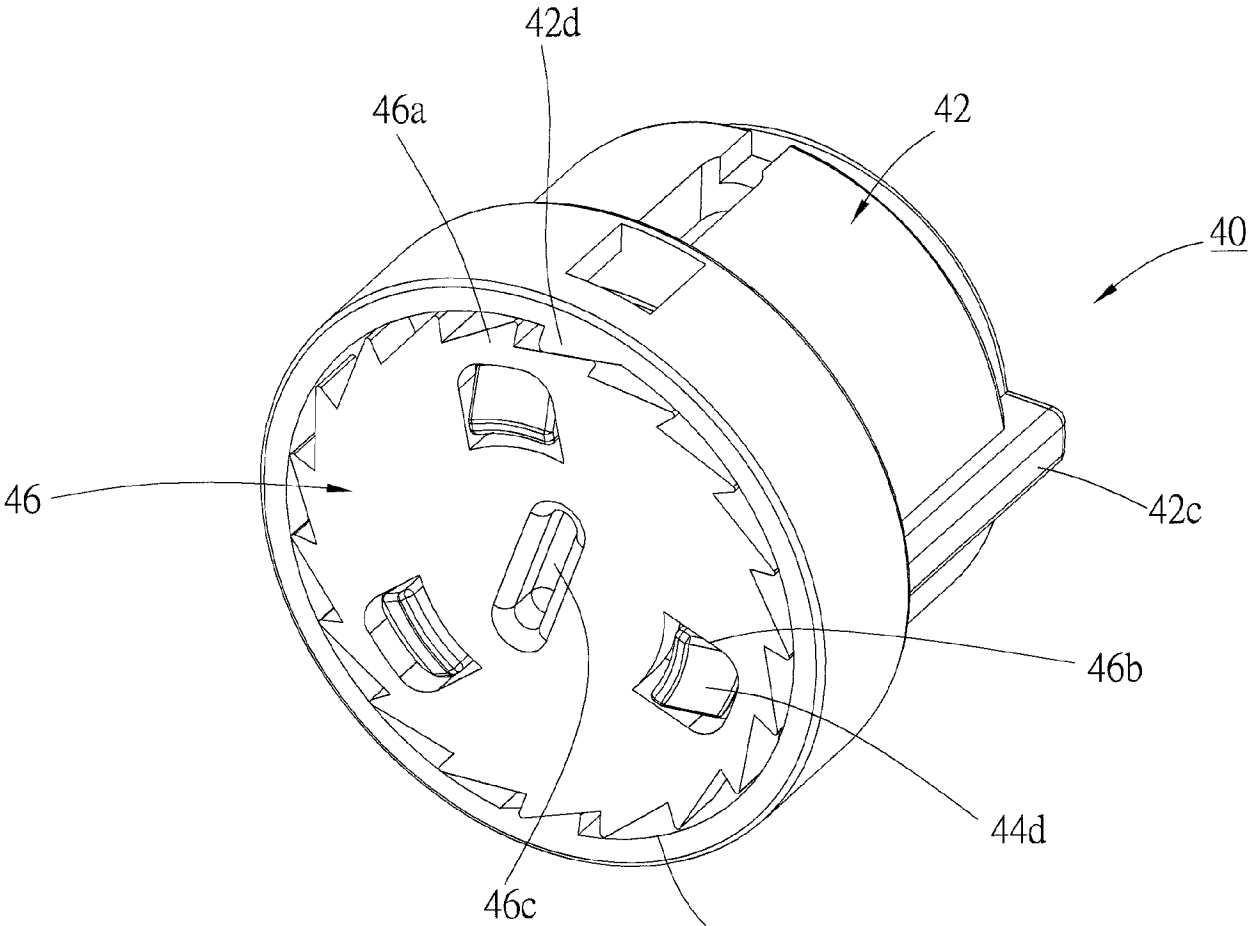
FIG. 9 is a perspective view of the cord locker of the third preferred embodiment of the present invention.

FIG. 8 and FIG. 9 show a cord locker 40 of the third preferred embodiment of the present invention, which includes a barrel 42, a reel 44, and a control wheel 46. The barrel 42 has a top opening 42*a* on a top and two side openings 42*b* on an annular wall for the lift cord 18 to be inserted into the barrel 42 through any of them. The same as above, the reel 44 has a cord hole 44*b*, a recess at an end of the cord hole 44*b*, and a slot 44*c* breaking the reel 44 into two pieces. The barrel 42 also has ribs 42*c* to make the barrel 42 firmly engage the bottom rail 12. The different part of the third embodiment is that a pawl 42*d* is not on a flexible arm, it's on an inner side of the barrel 42 and adjacent to a bottom opening 42*e* thereof.

Figure 10:
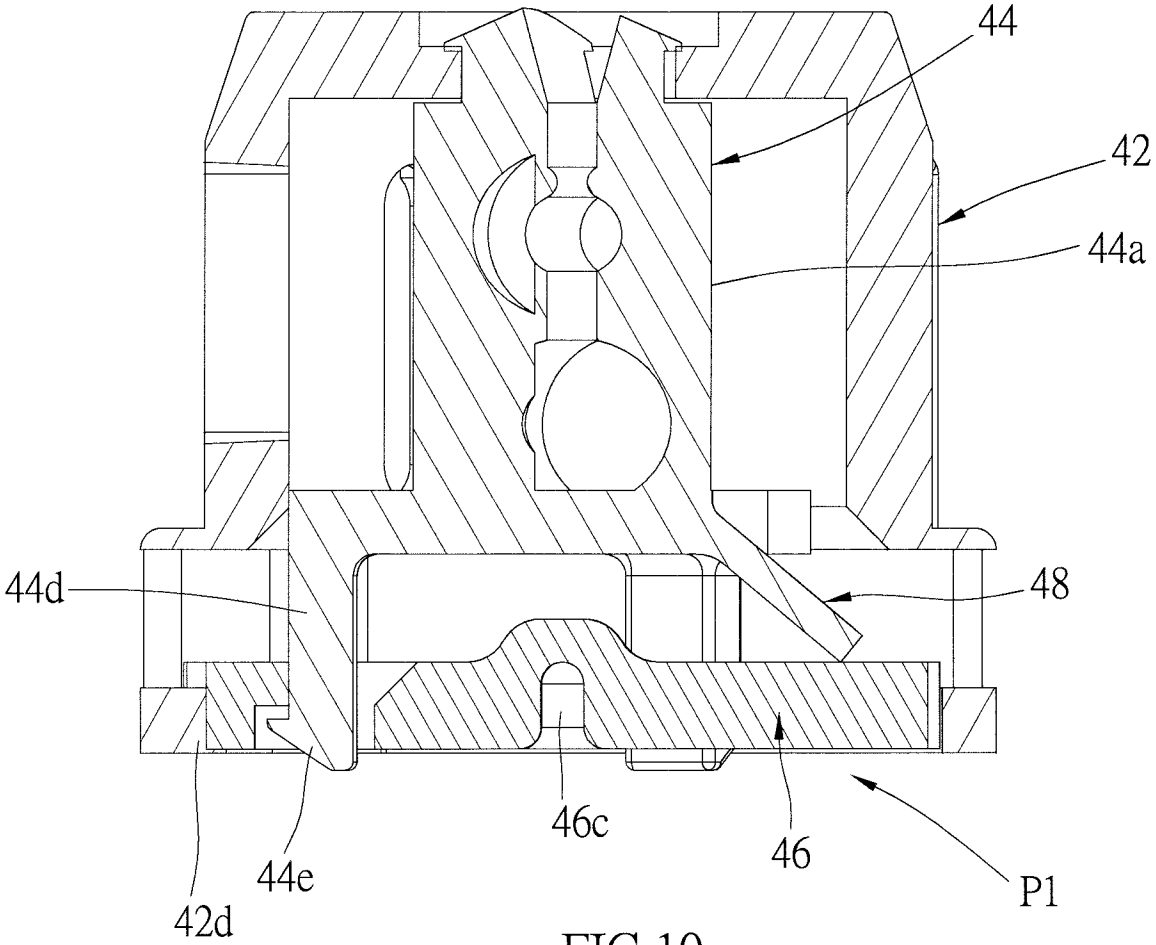
FIG. 10 is a sectional view of the cord locker of the third preferred embodiment of the present invention, showing the control wheel at the first position.
Figure 11:
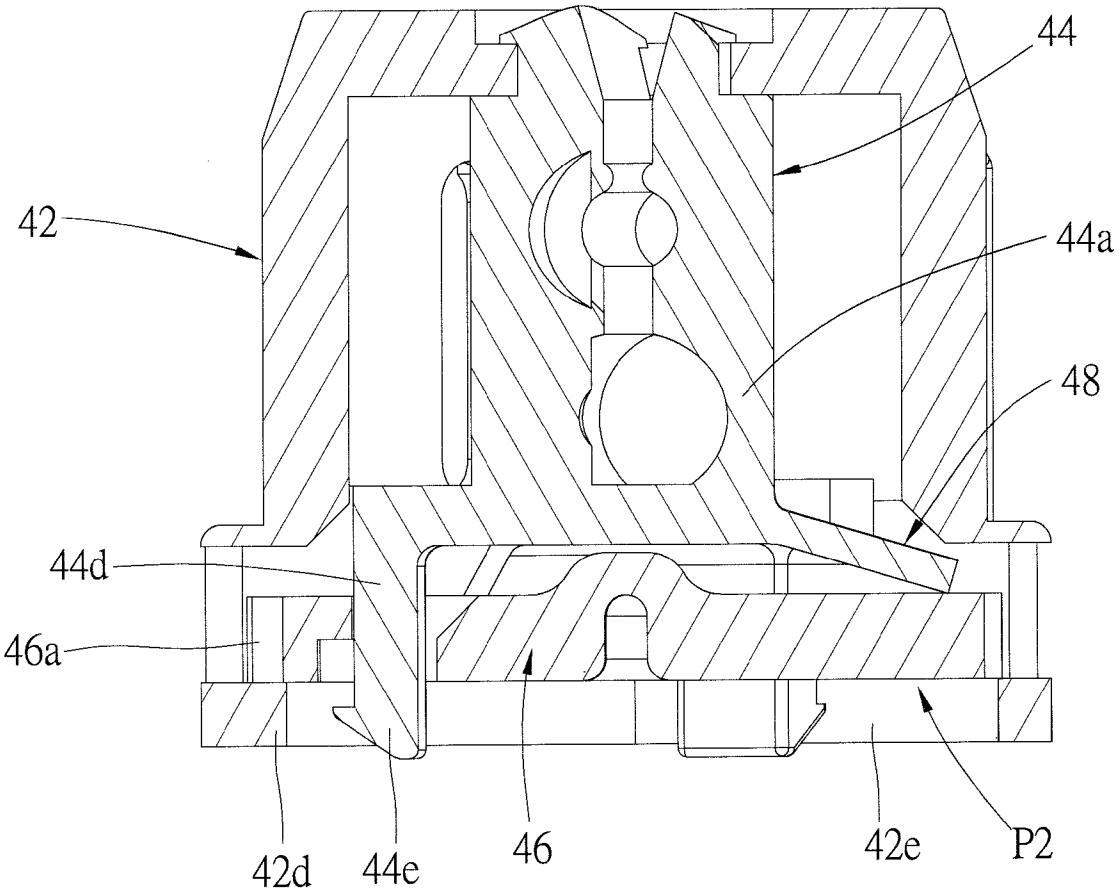
FIG. 11 is a sectional view of the cord locker of the third preferred embodiment of the present invention, showing the control wheel at the second position.

The reel 44 is connected to the control wheel 46, and both of them are received in the barrel 42. The control wheel 46 is provided with ratchet teeth 46*a* to be engaged with the pawl 42*a* to secure the control wheel 46 as well as the reel 44 while they are engaged. The reel 44 is provided with legs 44*d* projected from a bottom of a cord portion 44*a*, and each leg 44*d* is provided with a hook 44*e* at a distal end thereof. The control wheel 46 is provided with through holes 46*b* and a driving portion 46*c* (the straight slot). The legs 44*d* are inserted into the through hole 46*b* of the control wheel 46 respectively, and the hooks 44*e* extend out of the through hole 46*b* and engage an edge of the through hole 46*b* such that the control wheel 46 is able to move related to the reel 44 between a first position P1 (FIG. 10) and a second position P2 (FIG. 11). At the first position P1 the control wheel 46 keeps a distance from the reel 44, and the control wheel 46 moves towards the reel 44 while it move to the second position P2. In other words, the control wheel 46 at the second position P2 is closer to the reel 44 than the control wheel 46 at the first position P1. Furthermore, at the first position P1 the pawl 42*d* engages teeth 46*a* of the control wheel 46, and the pawl 42*d* disengages the teeth 46*a* when the control wheel 46 is moved to the second position P2.

Figure 12:
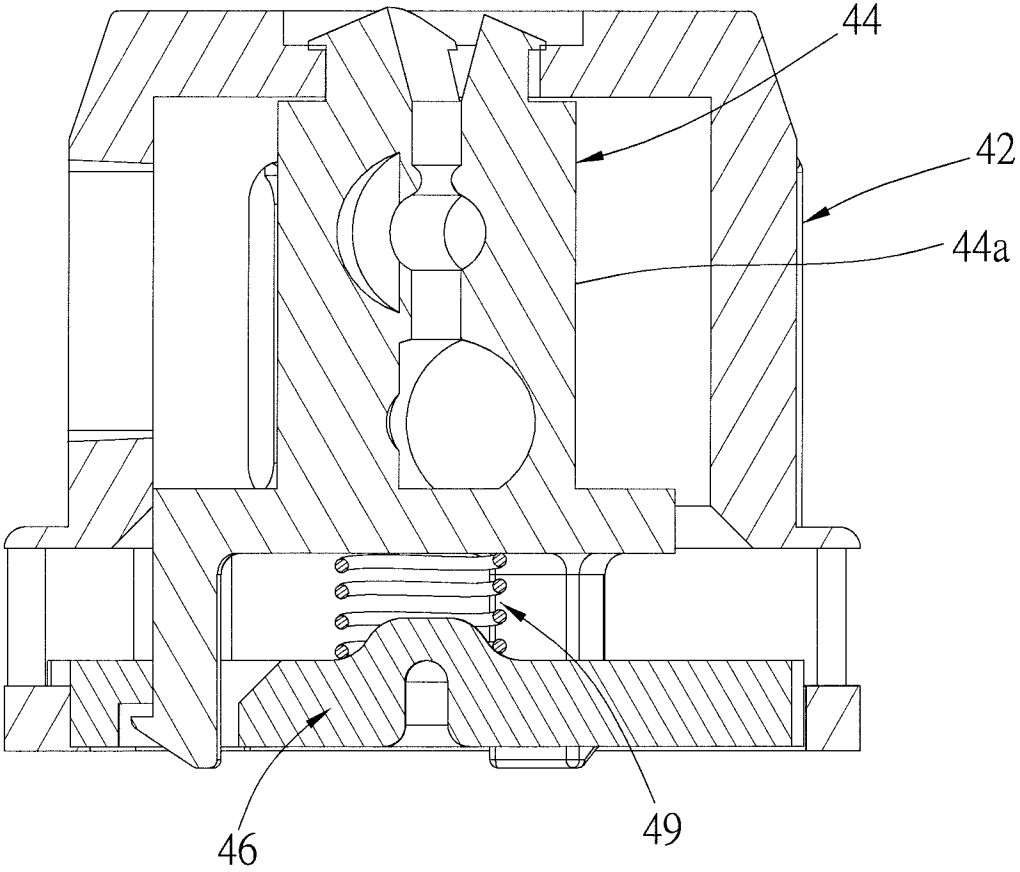
FIG. 12 is a sectional view of the cord locker, showing the spring between the reel and the control wheel.

The cord locker 40 further is provide with at least an elastic member between the reel 44 and the control wheel 46 to urge the control wheel 46 toward the first position P1. The control wheel 46 will be stopped at the first position P1 because of the hooks 44*e* of the legs 44. In the present embodiment, the elastic member includes several flexible pieces 48 projected from the reel 42. Distal ends of the flexible pieces 48 touch and urge the control wheel 46 toward the first position P1. An alternate elastic member is shown in FIG. 12, which is a spring 49 with opposite end urging the reel 44 and the control wheel 46. They achieve the same function.

While a user wants to regulate a length of the lift cord 18, he/she engages a screwdriver with the driving portion 46*c* of the control wheel 46, and pushes the control wheel 46 to the second position P2. At this time, the control wheel 46 is free to turn, and the user may turn the control wheel 46 in both directions to shorten or lengthen the lift cord 18. After regulation, he/she only has to release, and the elastic member will move the control wheel 46 back to the first position P1 right away to secure the reel 44 again.

Figure 13:
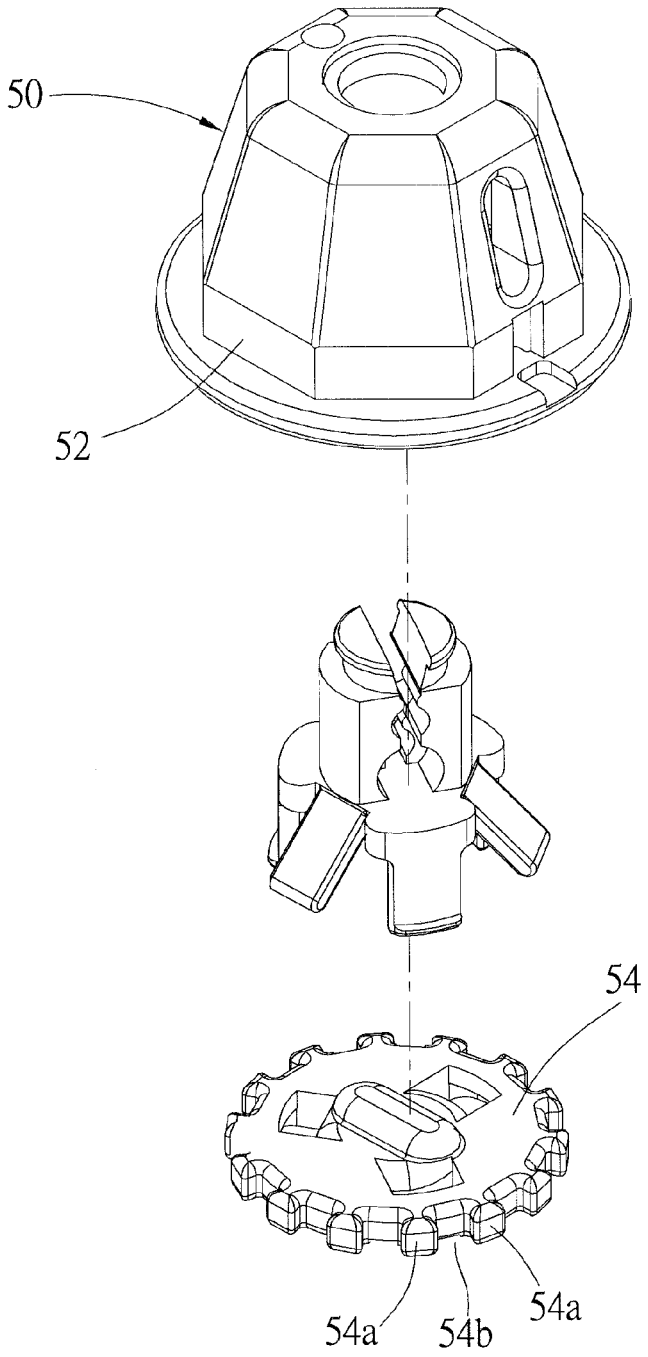
FIG. 13 is an exploded view of the cord locker, showing the polygonal barrel and the trapezoidal teeth on the control wheel.
Figure 14:
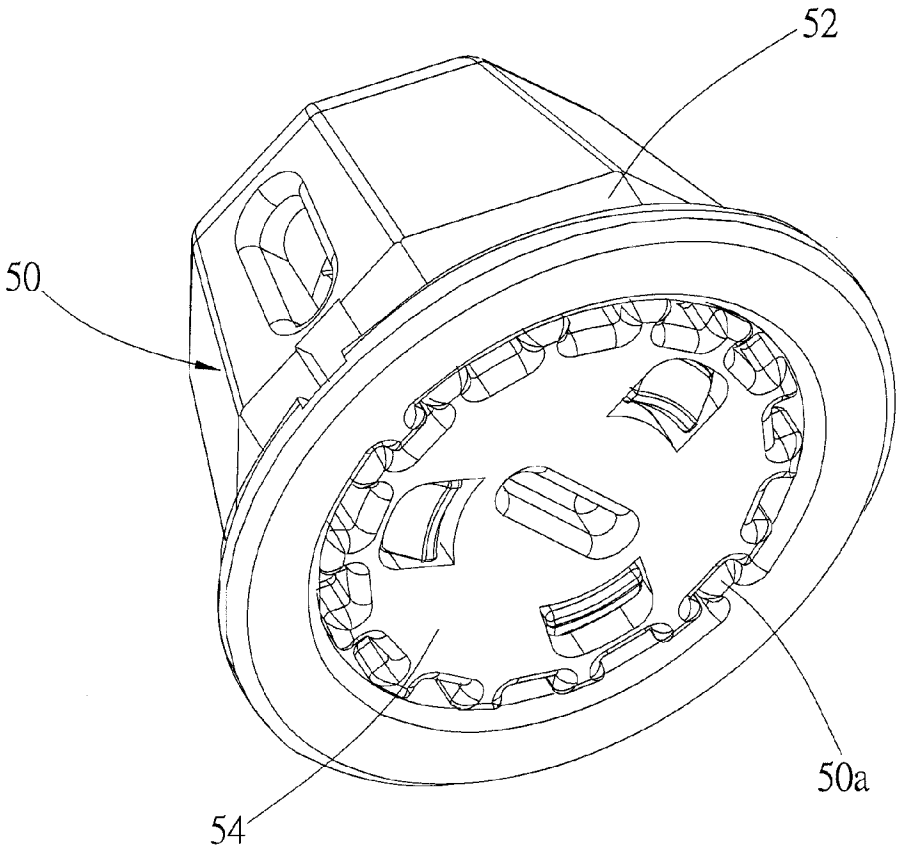
FIG. 14 is a perspective view of FIG. 13.

FIG. 13 shows a barrel 50, which has a polygonal cylinder 52 instead of the round cylinder as described above. The polygonal cylinder 52 may make the barrel 50 much firmly engage the bottom rail 13. FIG. 13 and FIG. 14 show an alternate design of teeth of the control wheel 54. The teeth 54*a* of the control wheel 54 are trapezoidal teeth, and recesses 54*b* between the trapezoidal teeth 54*a* are complementary to the pawl 50*a* for engagement.

It must be pointed out that the embodiments described above are only some preferred embodiments of the present invention. All equivalent methods which employ the concepts disclosed in this specification and the appended claims should fall within the scope of the present invention.

What is claimed is:

1. An adjustable cord locker, comprising:

a barrel;

a reel rotatably received in the barrel, wherein at least a lift cord is fastened to the reel to be wound around the reel while the reel is being rotated;

a control wheel connected to the reel, wherein the barrel has a bottom opening and a pawl provided therein; the control wheel is provided with teeth to be engaged with the pawl to hold the reel still;

a rotational axis of the reel is substantially parallel to an axial direction of the barrel, and the control wheel is connected to an end of the reel to cover the bottom opening of the barrel; and the control wheel has a through hole; the reel has a cord portion and a leg; the lift cord is wound on the cord portion; the leg is inserted into the through hole of the control wheel such that the control wheel moves along the leg between a first position and a second position; the pawl is engaged with the teeth of the control wheel when the control wheel is moved to the first position, and the pawl is disengaged with the teeth of the control wheel when the control wheel is moved to the second position.

2. The adjustable cord locker of claim 1, wherein the teeth of the control wheel are ratchet teeth which allow the control wheel to rotate in one direction only.

3. The adjustable cord locker of claim 1, wherein the reel is substantially vertical to an axial direction of the barrel, and some of the teeth of the control wheel extend out of the barrel through the bottom opening.

4. The adjustable cord locker of claim 1, wherein the barrel is provided with a flexible arm, on which the pawl is provided.

5. The adjustable cord locker of claim 1, further comprising an elastic member between the reel and the control wheel to urge the control wheel toward the first position.

6. The adjustable cord locker of claim 1, wherein the barrel is provided with a side opening on an annular wall thereof, and the reel is provided with a cord hole; the lift cord passes through the side opening and the cord hole in sequence, and is knotted to fasten the lift cord to the reel.

7. The adjustable cord locker of claim 1, wherein the barrel has a top opening communicated with the bottom opening.

8. The adjustable cord locker of claim 7, wherein the barrel is provided with a top board, on which the top opening is provided; the top board further has a bore, and the reel has an end engaged with the bore; the control wheel is provided with a driving portion for receiving an external force to turn the control wheel.

9. The adjustable cord locker of claim 7, wherein the reel is provided with a cord hole; the lift cord passes through the top opening and the cord hole in sequence, and is knotted to fasten the lift cord to the reel.

10. A window blind, comprising:

a headrail;

a bottom rail;

a plurality of slats between the headrail and the bottom rail;

at least a lift cord passing through the headrail and the slats in sequence, and connected to the bottom rail through an adjustable cord locker, wherein the adjustable cord locker comprises:

a barrel;

a reel received in the barrel for rotation, wherein the lift cord is fastened to the reel to be wound around the reel while the reel is being rotated;

a control wheel connected to the reel, wherein the barrel has a bottom opening and a pawl provided therein; the control wheel is provided with teeth to be engaged with the pawl to hold the reel still;

a rotational axis of the reel is parallel to an axial direction of the barrel, and the control wheel is connected to an end of the reel to cover the bottom opening of the barrel; and the control wheel has a through hole; the reel has a cord portion and a leg; the lift cord is wound on the cord portion; the leg is inserted into the through hole of the control wheel such that the control wheel move along the leg between a first position and a second position; the pawl is engaged with the teeth of the control wheel when the control wheel is moved to the first position, and the pawl is disengaged with the teeth of the control wheel when the control wheel is moved to the second position.

11. The adjustable cord locker of claim 10, wherein the teeth of the control wheel are ratchet teeth which allow the control wheel to rotate in one direction only.

12. The adjustable cord locker of claim 10, wherein the reel is vertical to an axial direction of the barrel, and some of the teeth of the control wheel extend out of the barrel through the bottom opening.

13. The adjustable cord locker of claim 10, wherein the barrel is provided with a flexible arm, on which the pawl is provided.

14. The adjustable cord locker of claim 10, further comprising an elastic member between the reel and the control wheel to urge the control wheel toward the first position.

15. The adjustable cord locker of claim 10, wherein the barrel is provided with a side opening on an annular wall thereof, and the reel is provided with a cord hole; the lift cord passes through the side opening and the cord hole in sequence, and is knotted to fasten the lift cord to the reel.

16. The adjustable cord locker of claim 10, wherein the barrel has a top opening communicated with the bottom opening.

17. The adjustable cord locker of claim 16, wherein the barrel is provided with a top board, on which the top opening is provided; the top board further has a bore, and the reel has an end engaged with the bore; the control wheel is provided with a driving portion for receiving an external force to turn the control wheel.

18. The adjustable cord locker of claim 16, wherein the reel is provided with a cord hole; the lift cord passes through the top opening and the cord hole in sequence, and is knotted to fasten the lift cord to the reel.

* * * * *